US007088201B2

(12) United States Patent
Piernas

(10) Patent No.: US 7,088,201 B2
(45) Date of Patent: Aug. 8, 2006

(54) THREE-DIMENSIONAL QUASI-COPLANAR BROADSIDE MICROWAVE COUPLER

(75) Inventor: Belinda Piernas, Milpitas, CA (US)

(73) Assignee: Eudyna Devices Inc., Yamanashi-ken (JP)

( * ) Notice: Subject to any disclaimer, the term of this patent is extended or adjusted under 35 U.S.C. 154(b) by 0 days.

(21) Appl. No.: 10/911,092

(22) Filed: Aug. 4, 2004

(65) Prior Publication Data

US 2006/0028295 A1 Feb. 9, 2006

(51) Int. Cl.
*H01P 5/12* (2006.01)
*H01P 5/18* (2006.01)

(52) U.S. Cl. ..... 333/116; 333/236

(58) Field of Classification Search ..... 333/109, 333/116, 236, 238
See application file for complete search history.

(56) References Cited

U.S. PATENT DOCUMENTS

| | | | | |
|---|---|---|---|---|
| 3,237,130 | A | 2/1966 | Cohn | |
| 3,562,674 | A | 2/1971 | Gerst | |
| 3,668,569 | A | 6/1972 | Herring | |
| 3,999,150 | A | 12/1976 | Caragliano et al. | |
| 4,375,053 | A | 2/1983 | Viola et al. | |
| 4,647,878 | A | 3/1987 | Landis et al. | |
| 4,809,356 | A | 2/1989 | Peckham et al. | |
| 5,061,824 | A | 10/1991 | Alexander et al. | |
| 5,075,646 | A | 12/1991 | Morse | |
| 5,304,959 | A * | 4/1994 | Wisherd et al. | 333/26 |
| 5,446,425 | A | 8/1995 | Banba | |
| 5,448,771 | A | 9/1995 | Klomsdorf et al. | |
| 5,539,360 | A | 7/1996 | Vannatta et al. | |
| 5,625,328 | A | 4/1997 | Coleman, Jr. | |
| 5,634,208 | A * | 5/1997 | Nishikawa et al. | 455/327 |
| 5,689,217 | A | 11/1997 | Gu et al. | |
| 5,767,753 | A | 6/1998 | Ruelke | |
| 5,841,328 | A | 11/1998 | Hayashi | |
| 5,907,266 | A | 5/1999 | Budka et al. | |
| 6,005,895 | A | 12/1999 | Perino et al. | |
| 6,208,220 | B1 | 3/2001 | Logothetis | |
| 6,483,398 | B1 | 11/2002 | Nagamori et al. | |
| 6,533,586 | B1 | 3/2003 | Marketkar et al. | |

(Continued)

FOREIGN PATENT DOCUMENTS

JP 405037213 A 2/1993

(Continued)

OTHER PUBLICATIONS

I. Toyoda, et al., "Multilayer MMIC Branch-Line Coupler and Broad-Side Coupler," *IEEE 1992 Microwave and Millimeter-Wave Monolithic Circuits Symposium*, Jun. 1992, pp. 79-82.

(Continued)

*Primary Examiner*—Dean Takaoka
(74) *Attorney, Agent, or Firm*—Christie, Parker & Hale, LLP

(57) ABSTRACT

A broadside 90° microwave coupler is composed of three metal layers in a homogeneous dielectric media. The coupler is constructed in a multi-layer configuration with two conductor strips arranged on top of each other so as to be electro-magnetically coupled. A ground plane formed with a third metal layer below the coupled conductor strips is opened so that it is separated from the conductor strips by a gap. The two conductor strips are fully embedded into the dielectric layer. The characteristic physical dimensions of the coupler are determined to achieve the desired coupling coefficient while maintaining low reflection, high isolation and phase balance at the output ports of the coupler.

18 Claims, 14 Drawing Sheets

U.S. PATENT DOCUMENTS

| | | | |
|---|---|---|---|
| 6,611,181 | B1 | 8/2003 | Marketkar et al. |
| 6,614,325 | B1 | 9/2003 | Kocin |
| 6,704,277 | B1 | 3/2004 | Dabral et al. |

FOREIGN PATENT DOCUMENTS

| | | | |
|---|---|---|---|
| JP | 406216613 | A | 8/1994 |
| WO | WO 2004/034505 | A1 | 4/2004 |

OTHER PUBLICATIONS

F. Mernyei, et al., "A Novel MMIC Coupler-Measured and Simulated Data," *IEEE MTT-S International Microwave Symposium Digest*, 1994, pp. 229-232, vol. 1.

M. Engels, et al., "Design of quasi-ideal Couplers using Multiplayer MMIC Technology," *IEEE MTT-S International Microwave Symposium Digest*, 1996, pp. 1181-1184, vol. 2.

A. Minakawa, et al., "A Millimeter-Wave Band MMIC Dual-Quadrature Up-Converter Using Multilayer Directional Couplers," *IEEE Transactions on Microwave Theory and Techniques*, Jan. 1997, pp. 78-82, vol. 45, No. 1.

R. Mongia, et al., *RF and Microwave Coupled-Line Circuits*, Chapter 4, pp. 123-160, Artech House, Massachusetts.

K. Sachse, et al., "Novel, Multilayer Coupled-Line Structures and Their Circuit Applications," *Microwaves, Radar and Wireless Communications*; May 22, 2001; pp. 131-155, 13th International Conference on May 22-24, 2000; IEEE, Piscataway, New Jersey, USA.. (XP010537480).

C. Y. Ng, et al, "Miniature 38GhZ Couplers and Baluns using Multilayer GaAs MMIC Technology," *33rd European Microwave Conference-Munich 2003*, Oct. 7, 2003, pp. 1435-1438, vol. 3, IEEE, Piscataway, New Jersey, USA.. (XP010681336).

Sarmad Al-Taei, "Design of High Directivity Directional Couplers in Multilayer Ceramic Technologies," *2001 IEEE MTT-S International Microwave Symposium Digest*, May 20, 2001, pp. 51-54, vol. 1 of 3, IEEE, USA.

Internatioal Search Report and Written Opinion for PCT/US2005/028061 dated Nov. 8, 2005.

* cited by examiner

THREE-DIMENSIONAL QUASI-COPLANAR BROADSIDE MICROWAVE COUPLER

FIELD OF THE INVENTION

The present invention relates to the field of microwave couplers and, more particularly, to millimeter-wave couplers fabricated with a multi-layer technology.

BACKGROUND OF THE INVENTION

90° tight 3 dB couplers are key components in monolithic microwave integrated circuit (MMIC) technology. They are commonly used in the design of frequency converters, balanced amplifiers and modulators. For planar microstrip MMICs, there are few alternatives and 90° couplers are generally implemented through the use of Lange couplers or Branch-line couplers. Because of their large size such couplers are responsible of an important and irreducible part of the MMIC cost.

Recently, the introduction of the multi-layer or three-dimensional MMIC technology enabled the development of broadside couplers fabricated using transmission lines on top of each other and separated by a thin dielectric layer. Due to the multi-layer nature of broadside couplers, the thin film transmission lines can be folded in a meandering way to minimize the overall size.

Several configurations of Broadside coupler have been proposed in the literature: In Japanese Patent Document. No. 405037213, I. Toyoda et al. proposed a broadside coupler constructed with two conductor strips on different layers and a ground metal below the conductor strips. Details of this broadside coupler can also be found in the 1992 IEEE publication "Multilayer MMIC branch-line coupler and broad-side coupler" at pages 79–92.

The proposed topology enables tight 3 dB coupling but requires optimization of the polyimide layer thickness between the two conductor strips and to the ground resulting in little design flexibility. The design of such a coupler is usually done using electromagnetic simulation software and typically requires several optimizations to achieve optimum performance. Moreover, the control of the coupling factor is limited and tight 3 dB coupling can only be achieved for a specific value of the ground plane to respective conductor strips ratio of the polyimide layer thickness. Insertion loss is quite high in this case (~2 dB) due to the presence of the ground plane close to the conductor strips. Also, because of the ground plane being close to the conductor strips, isolation between the output coupled port and the output direct port is only −15 dB.

In 1994, Mernyei et al. demonstrated a new broadside-offset coupler. The device is the combination of the coplanar waveguide (CPW) line formed on a first metal layer and a microstrip (MS) line on a second metal layer above the first metal layer. A 5 μm thick polyimide layer separates the two metal layers.

The coupling in the structure is controlled by the offset spacing of the MS line above the CPW line and ranges between −3 dB and −30 dB. However, because of the CPW nature of the lower line, the characteristic dimensions of the coupler are large and the lines are unlikely to be foldable in a meandering way.

In 1996, M. Engels and R. H. Jansen proposed to realize broadside couplers (so called "quasi-ideal coupler") using three metal layers as shown in FIG. 1. First conducting strip 120 is formed on first dielectric layer 150. Second conducting strip 110 is formed on second dielectric layer 140.

Ground plane 131, 132 with a gap therein is formed between second dielectric layer 150 and substrate 160. In the same manner as the coupler proposed by I. Toyoda et al. the ground plane is placed on top of the substrate so that no backside processing is necessary.

Because of the difference of material surrounding the conductor strips, the analysis of the proposed topology refers to the analysis of asymmetrical coupled lines in inhomogeneous media. The characteristic dimensions (w1, w2, S, $S_{gnd}$ and h1 all normalized to h2) can be deduced from the resolution of the well-known mode parameters equations in inhomogeneous media.

The ground plane below the two conductor strips is open with a gap $S_{gnd}$ from the larger conductor strip to provide an additional degree of freedom so that the postulate of the mode parameter relation in inhomogeneous media can be satisfied.

M. Engels and R. H. Jansen didn't demonstrate experimentally the proposed concept. However, the optimization of the mode parameters using a quasi-static analysis ignoring frequency dispersion and loss, and assuming conductor strips of zero thickness, shows that potential ideal performance in term of input/output reflection and isolation can be achieved.

This result is particularly attractive. However, for the design of most MMIC involving a quadrature coupler, phase and amplitude balance prevail over any other characteristic. For example, the degradation of phase and amplitude imbalance has dramatic effect on the LO suppression ratio of a quadrature up-converter.

For the broadside coupler proposed by M. Engels and R. H. Jansen, the ideal quadrature between the coupled and the direct port cannot be achieved and the phase imbalance deviates linearly with the frequency. At millimeter-wave frequencies, the phase imbalance can be significant and strongly limit the use of such a broadside coupler.

M. Engels and R. H. Jansen proposed to compensate the phase dispersion by connecting a transmission line to both ports of one of the conductor strip. However, this contributes to the degradation of the amplitude imbalance and compactness of the coupler.

Therefore, the prior art has limitations that the present invention seeks to overcome.

SUMMARY OF THE INVENTION

A three-dimensional quasi-coplanar broadside coupler supported on a substrate is provided. A pair of electro-magnetically coupled conductors has a first conductive strip and a second conductive strip arranged in respective substantially parallel conductive strip planes. A ground plane is located in a plane substantially parallel to the parallel conductive strip planes, the first conductive strip being proximal to the ground plane and the second conductive strip being distal to the ground plane, the ground plane being between the first conductive strip and the substrate. The ground plane is open below the first conductive strip and the second conductive strip and is laterally separated from each farthest lateral extremity of the pair of electro-magnetically coupled conductors by a respective gap. A dielectric material fully embeds therewithin the first conductive strip and the second conductive strip.

In an exemplary embodiment the ground plane may also be fully embedded within the dielectric material.

In another exemplary embodiment the dielectric material has a thickness providing homogeneity of material surrounding the pair of electro-magnetically coupled conductors.

In a further exemplary embodiment the pair of electromagnetically coupled conductors may be straight or may be arranged in a meandering configuration.

In still another exemplary embodiment the first conductive strip and the second conductive strip overlap each other.

In yet another exemplary embodiment the first conductive strip and the second conductive strip may be aligned to be centered on each other.

In a still further exemplary embodiment the dielectric material includes layers of dielectric material.

In another exemplary embodiment the dielectric material includes a dielectric layer formed between the ground plane and the substrate for fabrication of active devices on the substrate.

DETAILED DESCRIPTION

Figure 1:
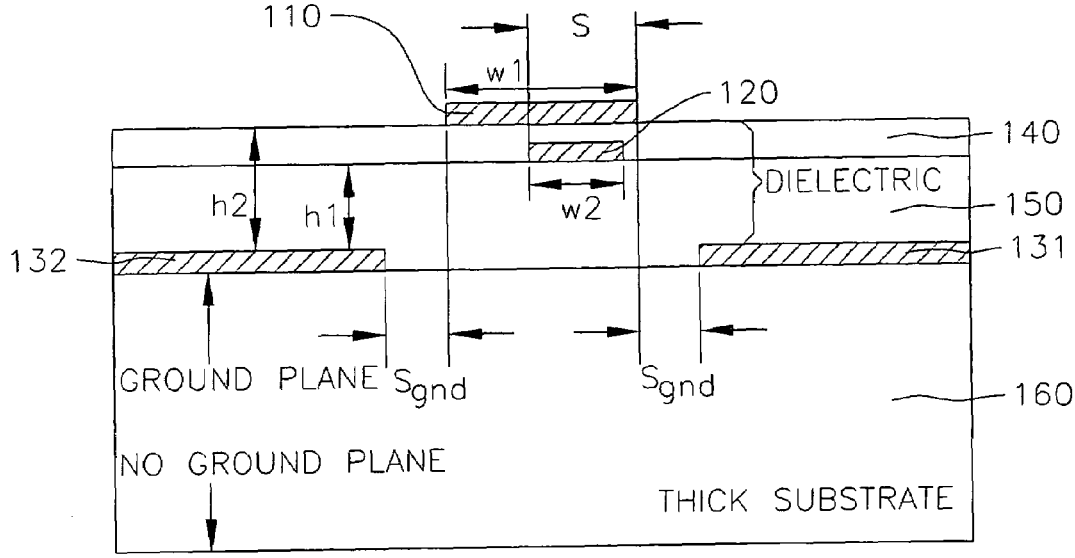
FIG.1 (PRIOR ART)
FIG. 1 is a cross-section of a prior art broadside coupler.
Figure 2:
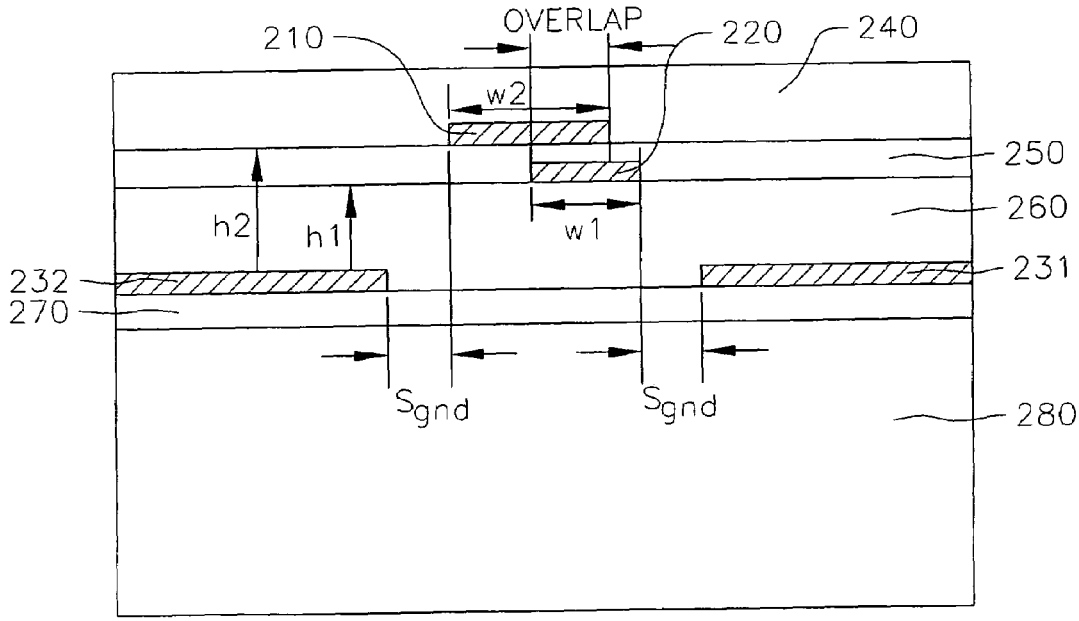
FIG. 2 is a generic cross-section of an exemplary embodiment of a three-dimensional quasi-coplanar broadside coupler in accordance with the present invention having two conductor strips overlapping each other.

Referring now to FIG. 2, in accordance with the present invention a multi-layer coupler is provided composed of conductive material (e.g., metal) conductor strip 210 electromagnetically coupled to conductive material conductor strip 220 both above conductive material ground plane 231, 232. Ground plane 231, 232 can be built on top of intermediate dielectric layer 270 formed over substrate 280 or be built directly over substrate 280 (e.g., dielectric layer 270 would not exist in this case). Intermediate dielectric layer 270 if inserted, enables the fabrication of active devices on substrate 280 and below ground plane 231, 232 without affecting coupler characteristics when used with MMIC technology.

Ground plane 231, 232 is placed below coupler conductor strips 210, 220 to shield the coupler performance from substrate 280 and any eventual active devices built on substrate 280. Therefore, the substrate thickness and properties have negligible effect on coupler performance and embodiments of the present invention can be potentially integrated with any active device technology.

Ground plane 231, 232 is open below the coupler and is separated laterally from conductor strips 210, 220 by gaps $S_{gnd}$. The opening in ground plane 231, 232 reduces loss to ground, improves the coupling between conductor strips 210, 220 and improves the isolation characteristics of the coupler.

Still referring to FIG. 2, for a fixed position of two conductor strips 210, 220 with respect to each other and to ground plane 231, 232, maximum coupling and optimum isolation occur when $S_{gnd}$ tends to be of infinite value. Combined with the effect of top dielectric layer 240 an opening in ground plane 231, 232 below the coupler helps in the formation of an homogenous medium around conductor strips 210, 220.

First conductor strip 220 of width w1 is formed at a vertical distance h1 above ground plane 231, 232 and on top of dielectric layer 260. Second conductor strip 210 of width w2 is formed on top of dielectric layer 250 above first conductor strip 220 and at vertical distance h2 above ground plane 231, 232. Eventually, dielectric layer 240 is used to cover second conductor strip 210 so that both conductor strips 210, 220 are fully embedded into respective dielectric layers 240, 250, 260. The same dielectric material is used to form dielectric layers 240, 250, 260, 270 to ensure homogeneity of the media surrounding conductor strips 210, 220.

The full embedding of conductor strips 210, 220 into the same dielectric material prevents phase dispersion of signals through conductor strips 210, 220. Assuming that the combination of top dielectric layer 240 and opening in ground plane 231, 232 provides enough homogeneity around coupler's conductor strips, the prevailing 90° phase difference between a coupled and a direct port of a quarter-wavelength coupler can be achieved at the center frequency at which coupler has been designed. Top dielectric layer 240 does not noticeably affect isolation and transmission characteristics of the coupler.

Still referring to FIG. 2, an overlapping between conductor strips 210, 220 constitutes another embodiment of the present invention. A low level of coupling is achieved by decreasing the overlapping between conductor strips 210, 220 bringing them further apart from each other.

Figure 3:
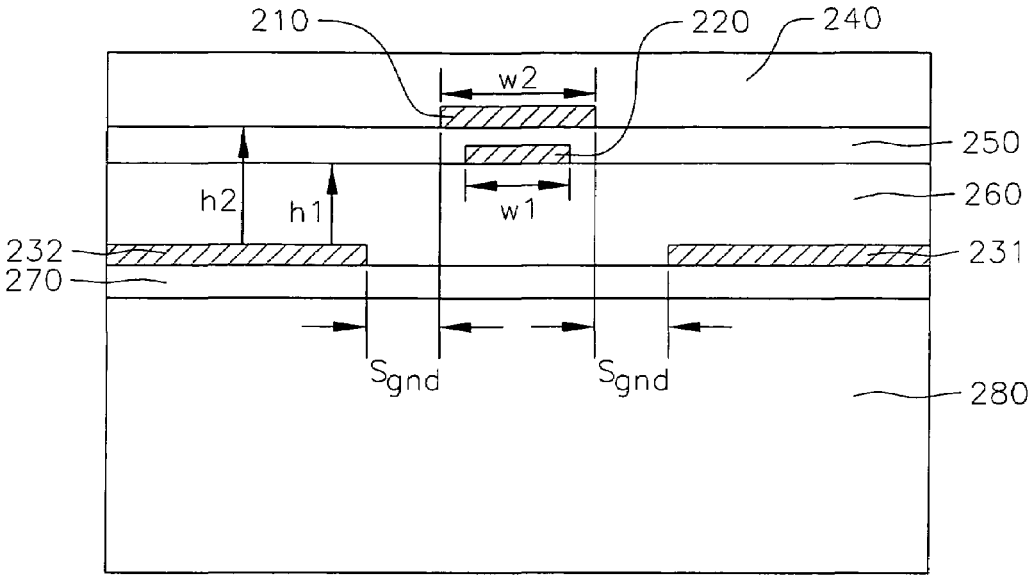
FIG. 3 is a cross-section of an exemplary embodiment of a three-dimensional quasi-coplanar broadside coupler in accordance with the present invention having two conductor strips centered on each other.

Now referring to FIG. 3, maximum coupling can be achieved with h1, h2 and $S_{gnd}$ fixed when conductor strips 210, 220 fully overlap and are centered on each other. Overlapping between conductor strips 210, 220 allows the coupling coefficient to be adjusted without noticeably affecting the input and output return loss of the coupler.

Figure 4:
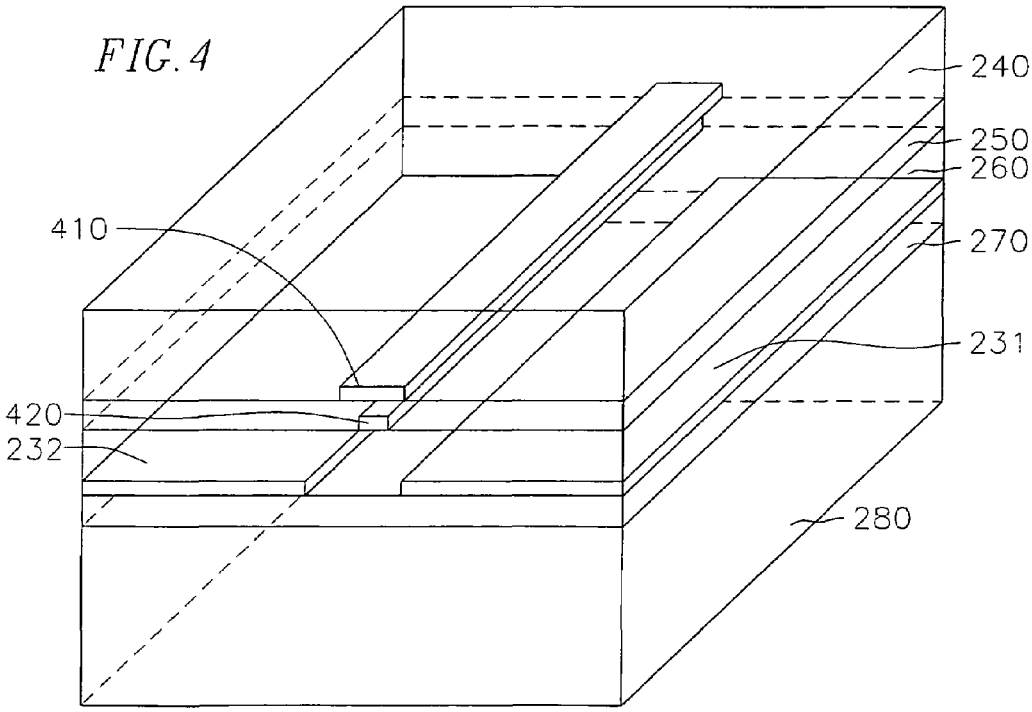
FIG. 4 is a perspective view of an exemplary embodiment of a three-dimensional quasi-coplanar broadside coupler in accordance with the present invention having two straight conductor strips.
Figure 5:
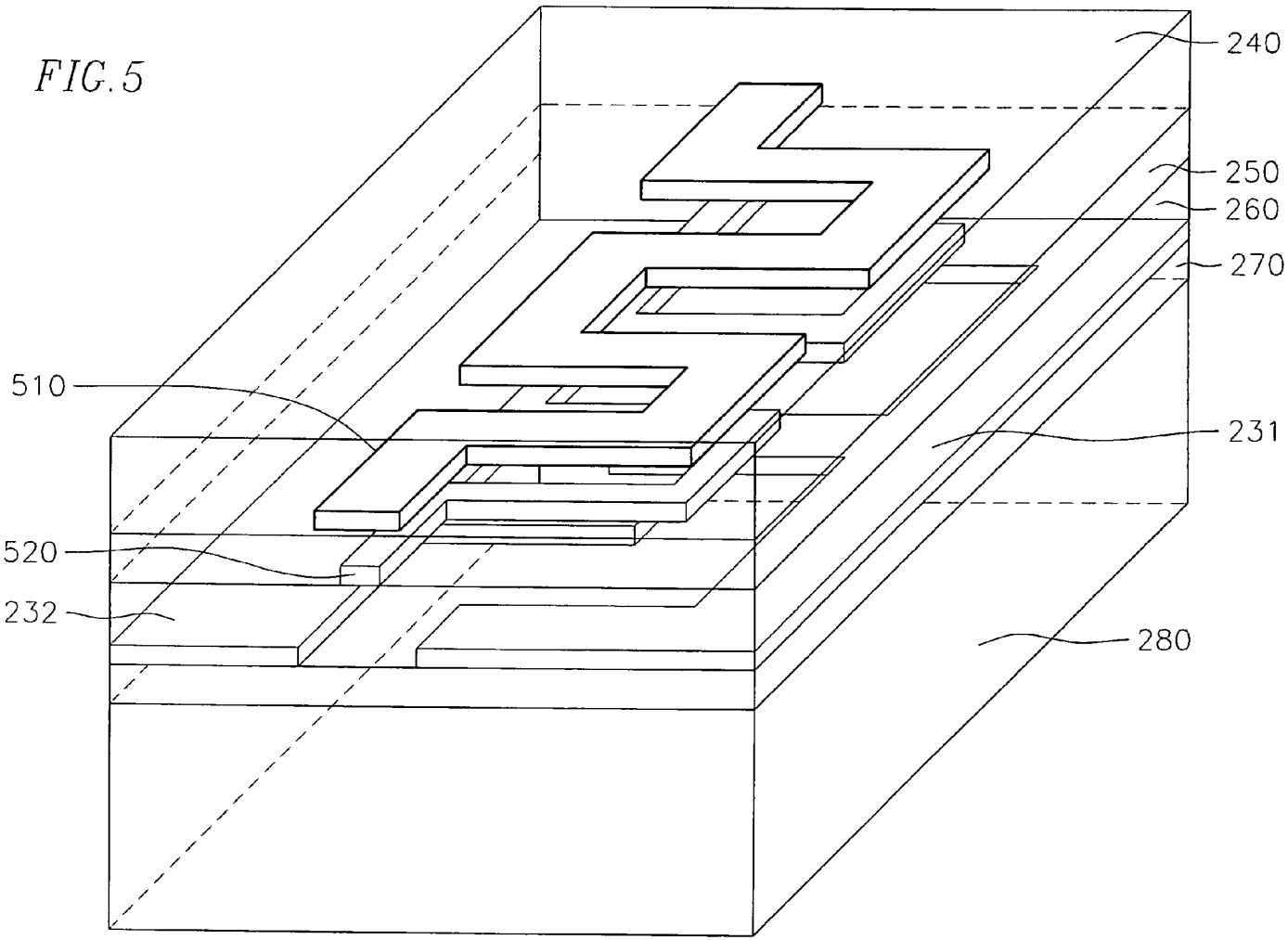
FIG. 5 is a perspective view of an exemplary embodiment of a three-dimensional quasi-coplanar broadside coupler in accordance with the present invention having conductor strips arranged in a meandering configuration.

Further in accordance with an embodiment of the present invention, conductor strips 410, 420 can be formed straight as shown in FIG. 4 or, as shown in FIG. 5, conductor strips 510, 520 can be arranged in a meandering configuration to reduce area and cost of the coupler.

Figure 6:
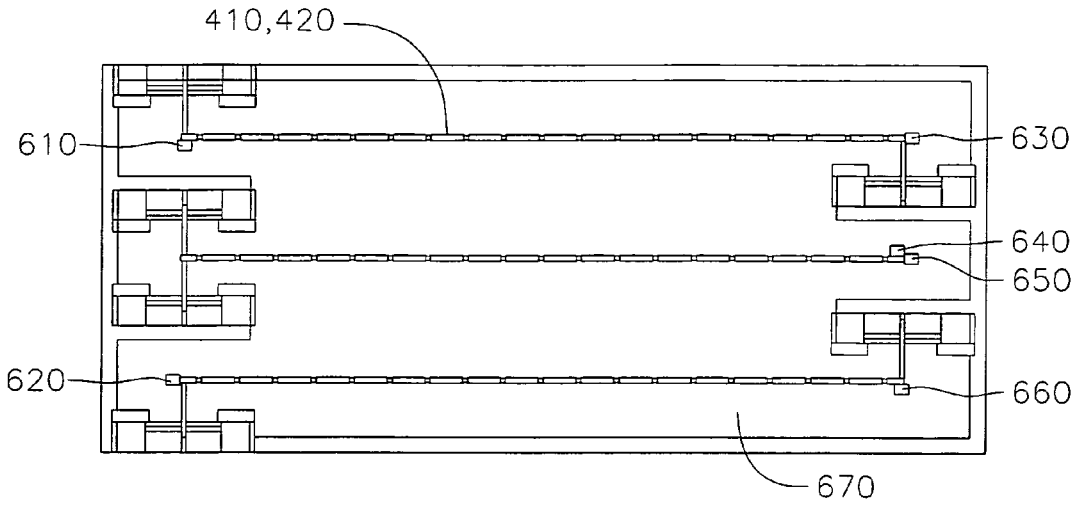
FIG. 6 shows a photograph of a fabricated three-dimensional quasi-coplanar broadside coupler in accordance with the present invention having two conductor strips straight and centered on each other.

FIG. 6 shows a top view photograph of a fabricated three-dimensional quasi-coplanar broadside coupler with conductor strips 410, 420 straight and centered on each other in accordance with FIG. 4. The coupler is fabricated with three test patterns to evaluate respectively direct transmission, coupled transmission and isolation between output ports. Non-measured output ports are terminated with 50-Ohm resistances 610, 620, 630, 640, 650, 660 to ground plane 670. Connections between ground plane 670, 50-Ohm resistances 610 to 660 and conductor strips 410, 420 are performed with small via holes through dielectric layers. Ground plane 670 is open around conductors strip 410, 420 with a gap $S_{gnd}$=5 μm from the larger conductor strip. The thickness of ground plane 670 is 1 μm. In accordance with FIG. 4, substrate 280 used to support the coupler may be made of Gallium Arsenide semiconductor material of thickness 250 μm. Ground plane 670 is fabricated over interface dielectric layer 270 of thickness 1 μm which is on top of substrate 280. Still in accordance with FIG. 4, first conductor strip 420 has a width w1=10 μm a thickness of 1 μm and is built on top of dielectric layer 260 of thickness h1=5 μm. Second conductor strip 410 has a width w2=9 μm a thickness of 2 μm and is fabricated on top of dielectric layer 250 of thickness h2=2.5 μm. Thicker conductor strips would result in lower sheet resistance of the conductive material (e.g., metal) and therefore lower insertion loss of conductor strips. Otherwise, the thickness of conductor strips 410, 420 or ground plane 670 would not affect other performance characteristics of the various embodiments of the present invention. Eventually, second conductor strip 410 is covered with dielectric layer 240 of thickness 3 μm. In accordance with the present invention, all dielectric layers 240, 250, 260, 270 are made of the same dielectric material, which may be, for example, a polyimide having a relative dielectric constant $\epsilon r$=3.5. Conductive material used to form conductor strips 410 and 420 and ground plane 670 may be gold.

Figure 7:
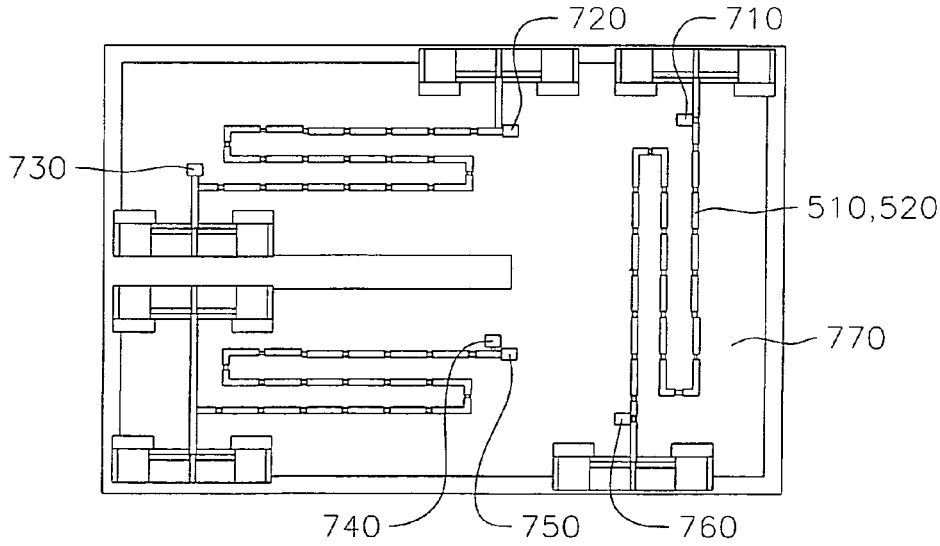
FIG. 7 shows a photograph of a fabricated three-dimensional quasi-coplanar broadside coupler in accordance with the present invention having conductor strips arranged in a meandering configuration.

FIG. 7 shows a top view photograph of a fabricated quarter wavelength three-dimensional quasi-coplanar broadside coupler in accordance with the present invention having conductor strips 510, 520 centered on each other and arranged in a meandering configuration as shown in FIG. 5. Technology used to fabricate the three-dimensional quasi-coplanar broadside coupler of FIG. 7 is the same as for the coupler of FIG. 6. The coupler has been fabricated with three test patterns to evaluate respectively direct transmission, coupled transmission and isolation between output ports. In the same manner as the coupler of FIG. 6, non-measured output ports are terminated with 50-Ohm resistances 710, 720, 730, 740, 750, 760 to ground plane 770. Connections between ground plane 770, 50-Ohm resistances 710 to 760 and conductor strips 510, 520 are formed with small via holes through the dielectric layers.

Figure 8:
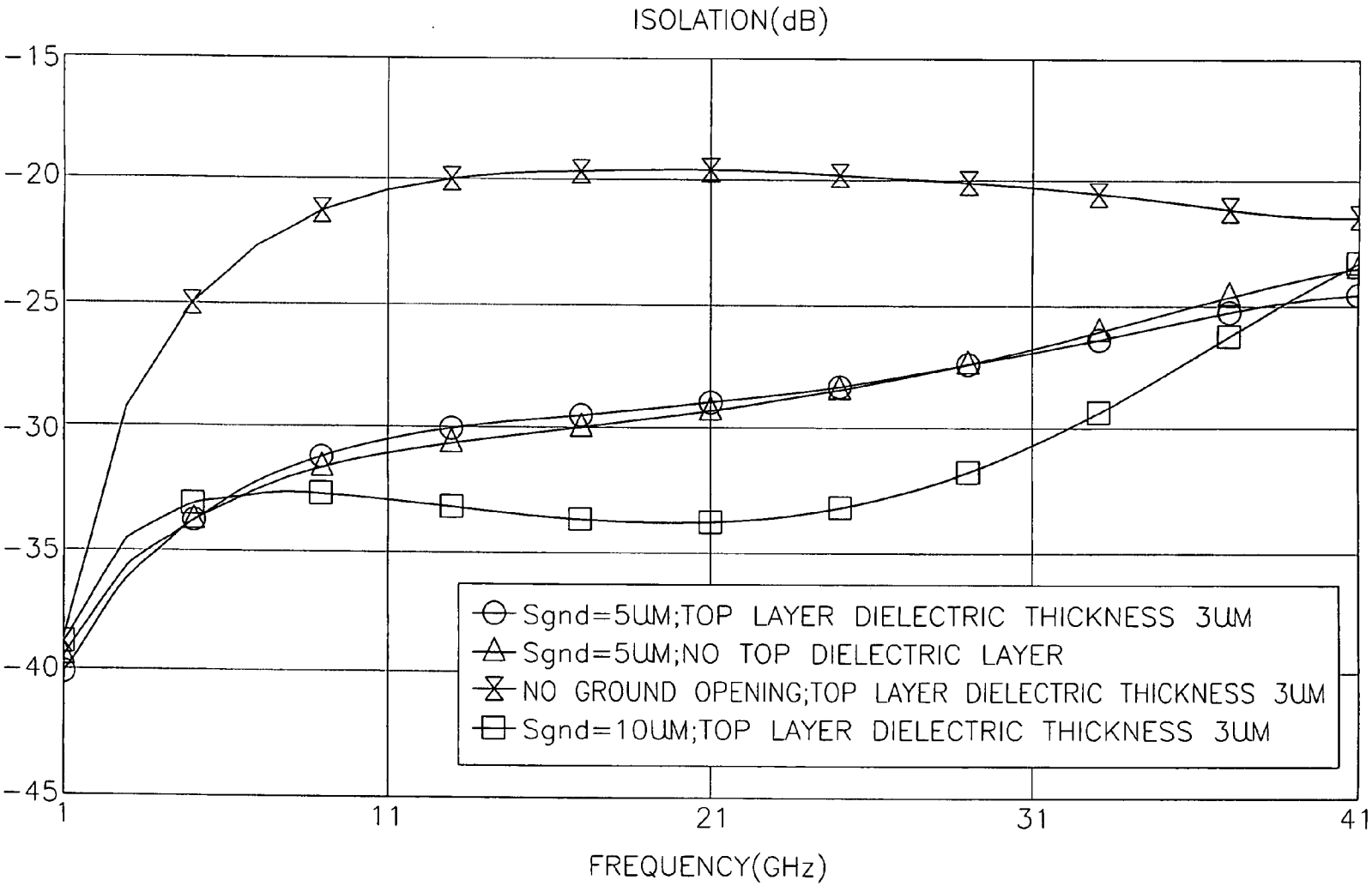
FIG. 8 is a graph depicting the result of electromagnetic simulation of the coupler isolation for different values of ground opening around the conductor strips.

FIG. 8 illustrates the effect of the ground plane opening on the isolation characteristic of the coupler between a direct port and a coupled port. The structure electro-magnetically simulated is characterized by the same physical dimensions as the fabricated three-dimensional quasi-coplanar broadside coupler of FIG. 6 designed in accordance with the present invention for an operation at center frequency $f_0$=22 GHz. First conductor strip 420 having width w1=10 μm is built on top of dielectric layer 260 of thickness h1=5 μm. Second conductor strip 410 having width w2=9 μm is fabricated on top of dielectric layer 250 of thickness h2=2.5 μm. All conductor materials (e.g., metal) are assumed to be of zero thickness for electromagnetic simulation. Substrate 280 is made of Gallium Arsenide of thickness 250 μm. On top of substrate 280 and below ground plane 670 is formed dielectric layer 270 of thickness 1 μm. All dielectric materials are considered to be polyimide having a relative dielectric constant $\epsilon r$=3.5. The trace with top dielectric layer 240 of thickness 3 μm and no opening of ground plane 670 below conductor strips shows poor isolation performance of the simulated coupler. The trace with top dielectric layer 240 of thickness 3 μm but ground plane 670 open around conductors strip with a gap $S_{gnd}$=5 μm from the larger conductor strip shows significant improvement of isolation performance. The traces when ground plane 670 is open around conductors strip with a gap $S_{gnd}$=5 μm but dielectric layer 240 is removed show no significant degradation of isolation performance and confirms that there is little effect of top layer 240 over coupler's isolation characteristic. Eventually, the trace with a larger opening $S_{gnd}$=10 μm of ground plane 670 around conductors strip with still top dielectric layer 240 of thickness 3 μm confirms improvement of the isolation characteristic.

Figure 9A:
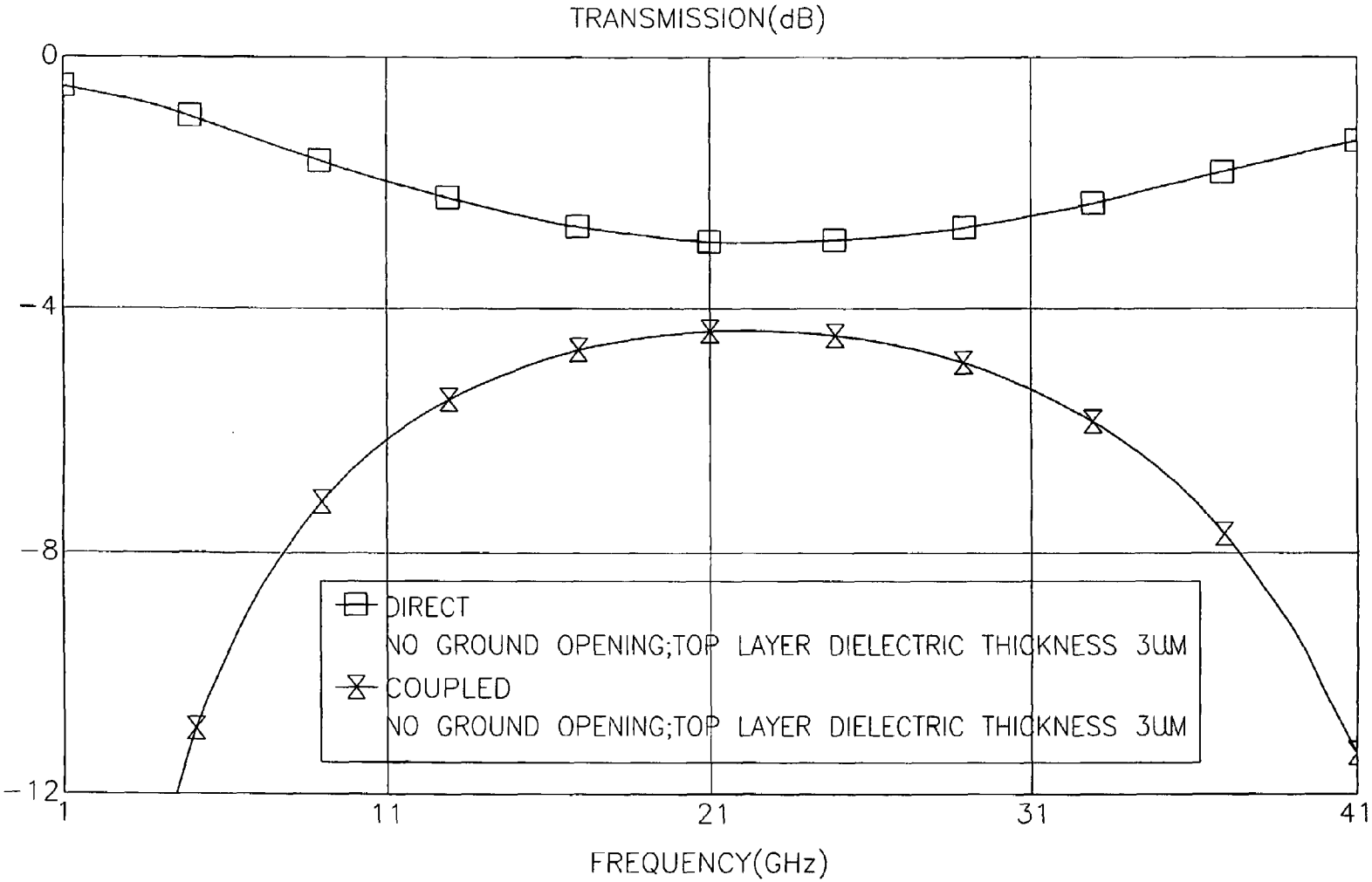
FIG. 9A is a graph depicting the result of electromagnetic simulation of the coupler transmission for no ground opening around the conductor strips and top dielectric layer thickness of 3 μm.
Figure 9B:
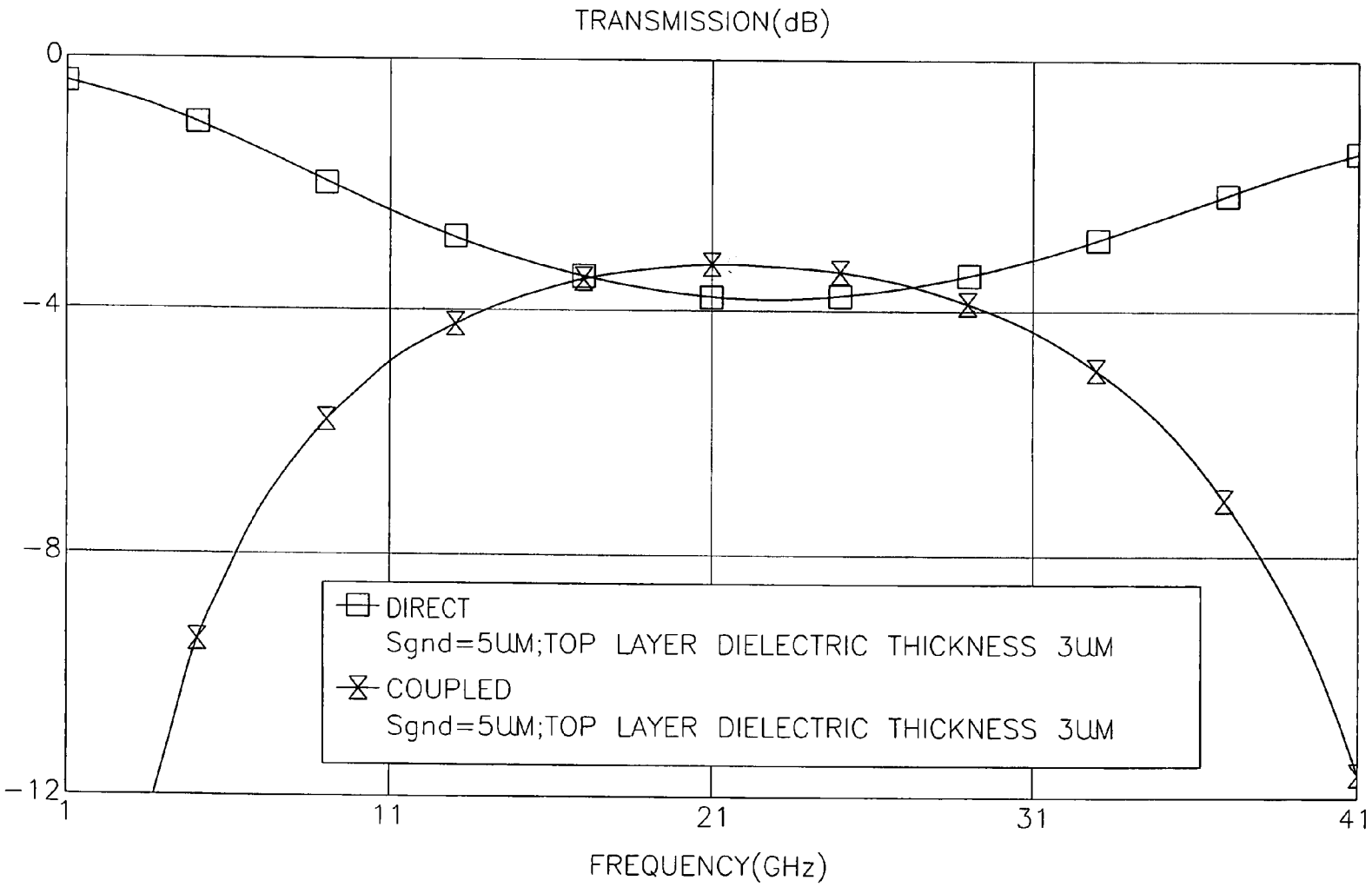
FIG. 9B is a graph depicting the result of electromagnetic simulation of the coupler transmission for a ground opening $S_{gnd}$=5 μm around the conductor strips and top dielectric layer thickness of 3 μm.
Figure 9C:
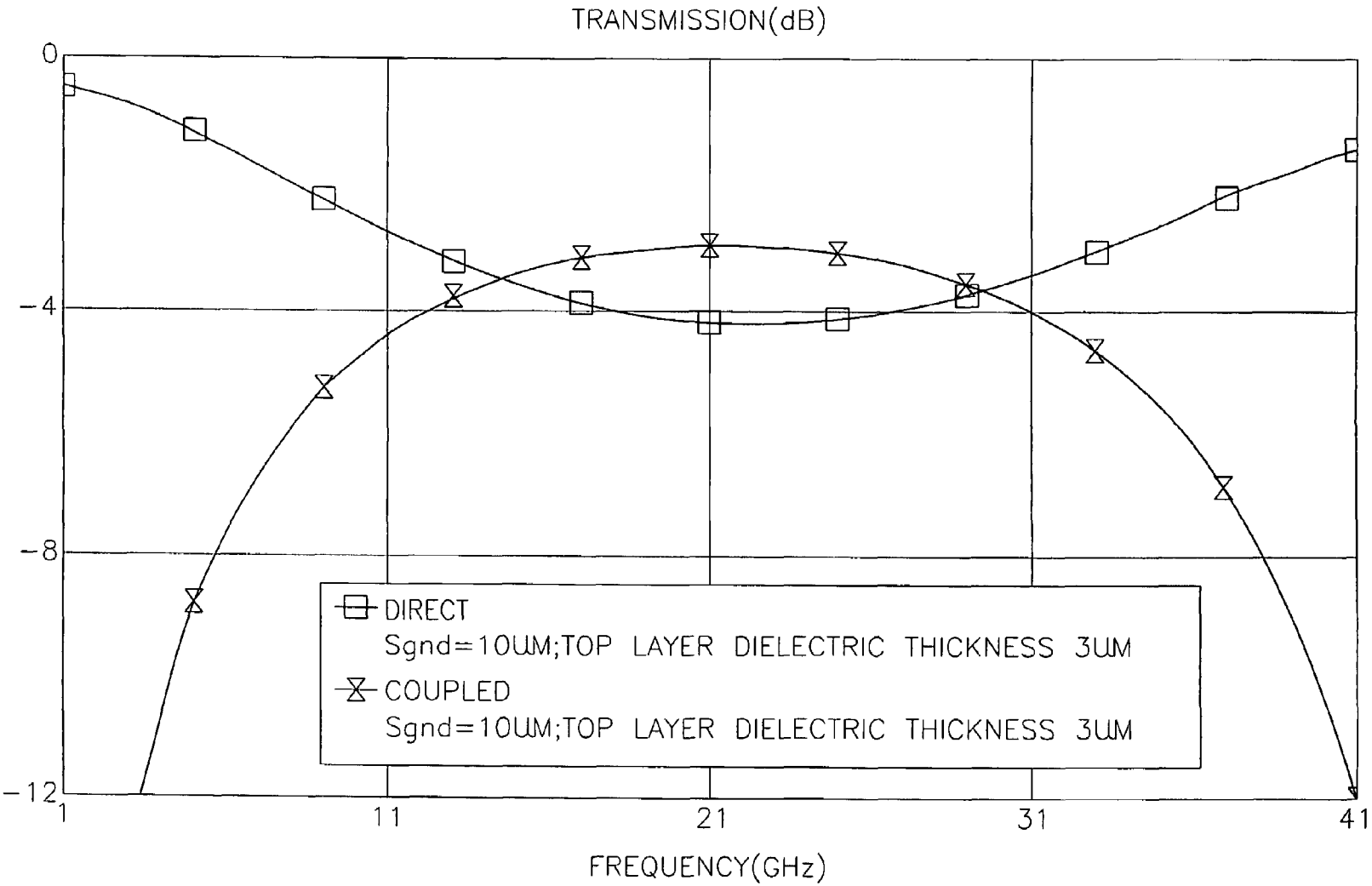
FIG. 9C is a graph depicting the result of electromagnetic simulation of the coupler transmission for a ground opening $S_{gnd}$=10 μm around the conductor strips and top dielectric layer thickness of 3 μm.
Figure 9D:
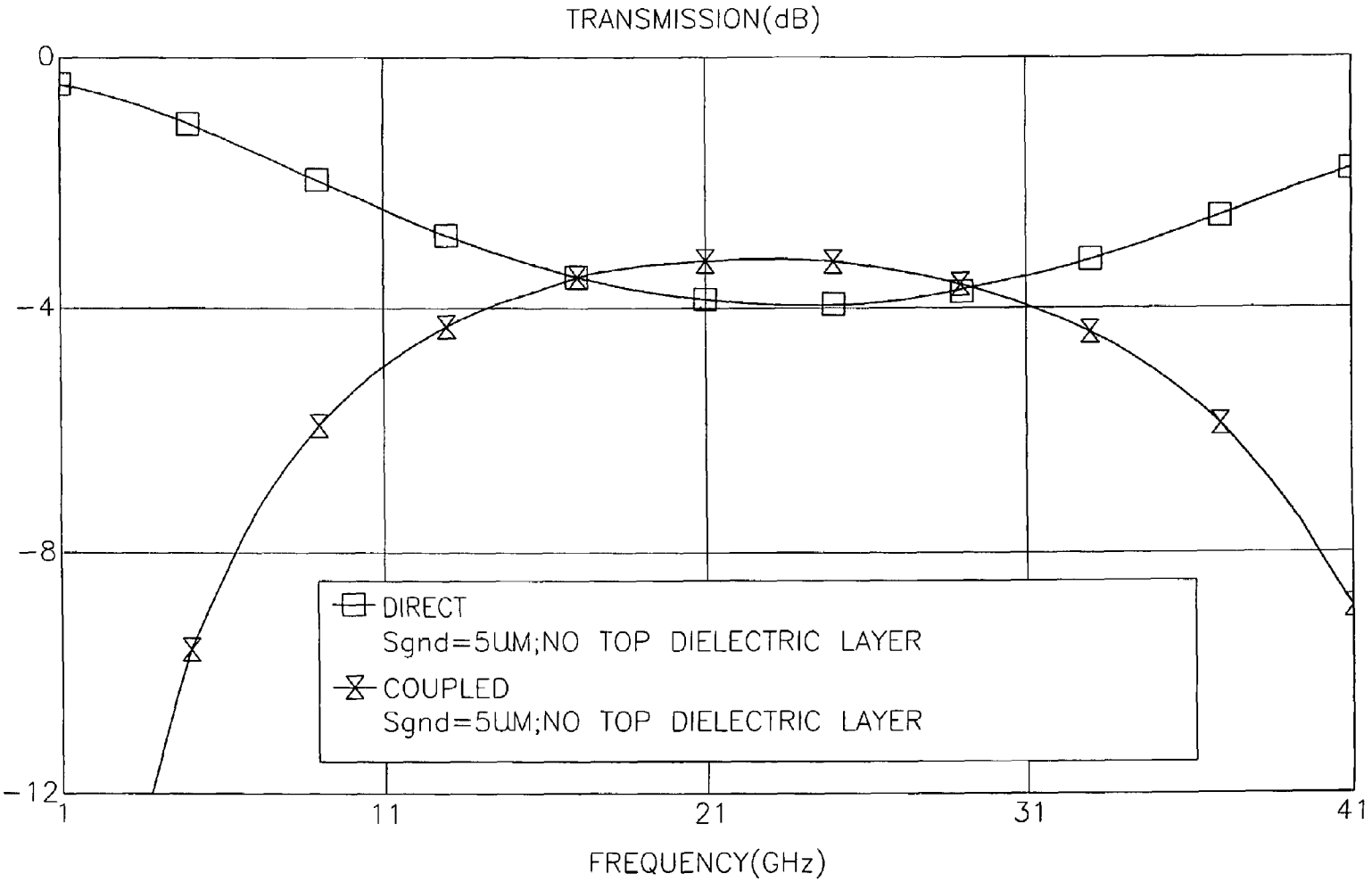
FIG. 9D is a graph depicting the result of electromagnetic simulation of the coupler transmission for a ground opening $S_{gnd}$=5 μm around the conductor strips and no top dielectric layer.

FIGS. 9A to 9D illustrate the effect of the ground plane opening on the transmission characteristic of the coupler between a direct port and a coupled port. The structure electro-magnetically simulated is characterized by the same physical dimensions as the fabricated three-dimensional quasi-coplanar broadside coupler of FIG. 6 designed in accordance with the present invention for an operation at center frequency $f_0$=22 GHz. First conductor strip 420 having width w1=10 μm is built on top of dielectric layer 260 of thickness h1=5 μm. Second conductor strip 410 having width w2=9 μm is fabricated on top of dielectric layer 250 of thickness h2=2.5 μm. All conductor materials (e.g., metal) are assumed to be of zero thickness for electromagnetic simulation. Substrate 280 is Gallium Arsenide of thickness 250 μm. On top of substrate 280 and below ground plane 670 is formed dielectric layer 270 of thickness 1 μm. All dielectric materials are considered to be polyimide of relative dielectric constant $\epsilon r$=3.5. FIG. 9A shows coupled and direct transmission of broadside coupler simulated with top dielectric layer 240 of thickness 3 μm and no opening of ground plane 670 below conductor strips. FIG. 9B and FIG. 9C shows coupled and direct transmission of broadside coupler simulated when an opening is provided through ground plane 670 with gaps $S_{gnd}$=5 μm and enlarged to $S_{gnd}$=10 μm respectively. Compared to FIG. 9A, coupling between the direct port and the coupled port increases as ground plane opening is enlarged. Coupling can be adjusted without significant effect on the other performance characteristics of the coupler by adjusting the overlapping between the two conductor strips. As seen in FIG. 9D compared to FIG. 9B, there is little effect from top dielectric layer 240 on direct and coupled transmission characteristic.

Figure 10:
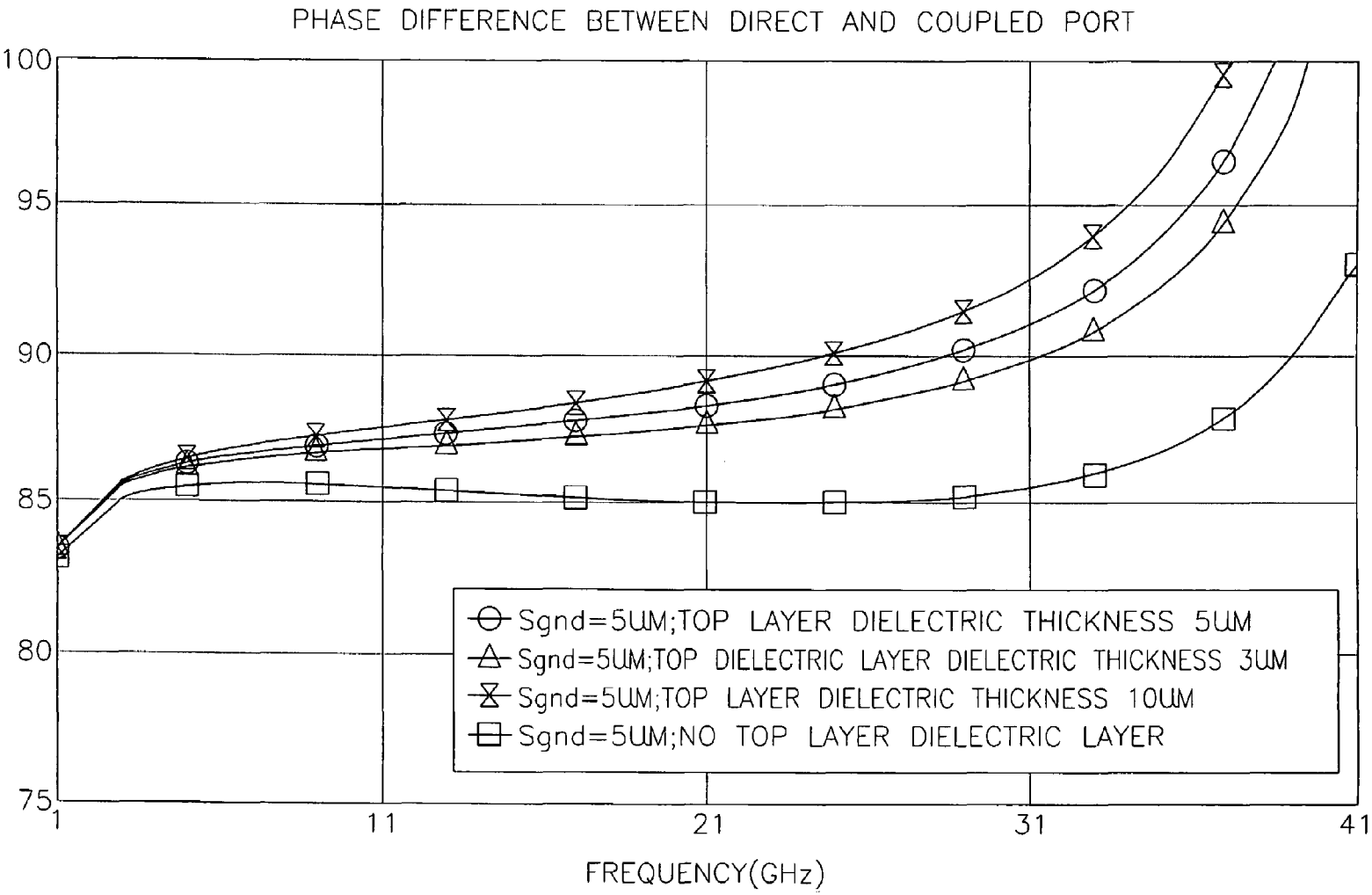
FIG. 10 is a graph depicting the result of electromagnetic simulation of the coupler phase difference between direct output signal and coupled output signal for different values of the top dielectric layer thickness in accordance with the present invention.

FIG. 10 illustrates the effect of top dielectric layer 240 on the phase difference characteristic in accordance with the present invention. The structure electro-magnetically simulated is the same as the one simulated for FIG. 8 and FIGS. 9A to 9D designed for an operation at center frequency $f_0$=22 GHz. Only the thickness of top dielectric layer 240 is varied. The gap between opened ground plane 670 and the conductive strips is fixed at $S_{gnd}$=5 μm. As specified above, the thickness of top dielectric layer 240 does not affect significantly the coupler's performance in terms of isolation characteristic and the coupling factor between the direct and the coupled port. However, as shown in FIG. 10, it affects directly phase dispersion between the direct output port and the coupled output port. The optimum thickness of dielectric material homogeneously surrounding the coupler conductor strips can therefore be determined to achieve a desired 90° phase difference between the coupled and the direct port of a quarter-wavelength coupler while maintaining a desired performance in terms of coupling, isolation and return loss.

Figure 11:
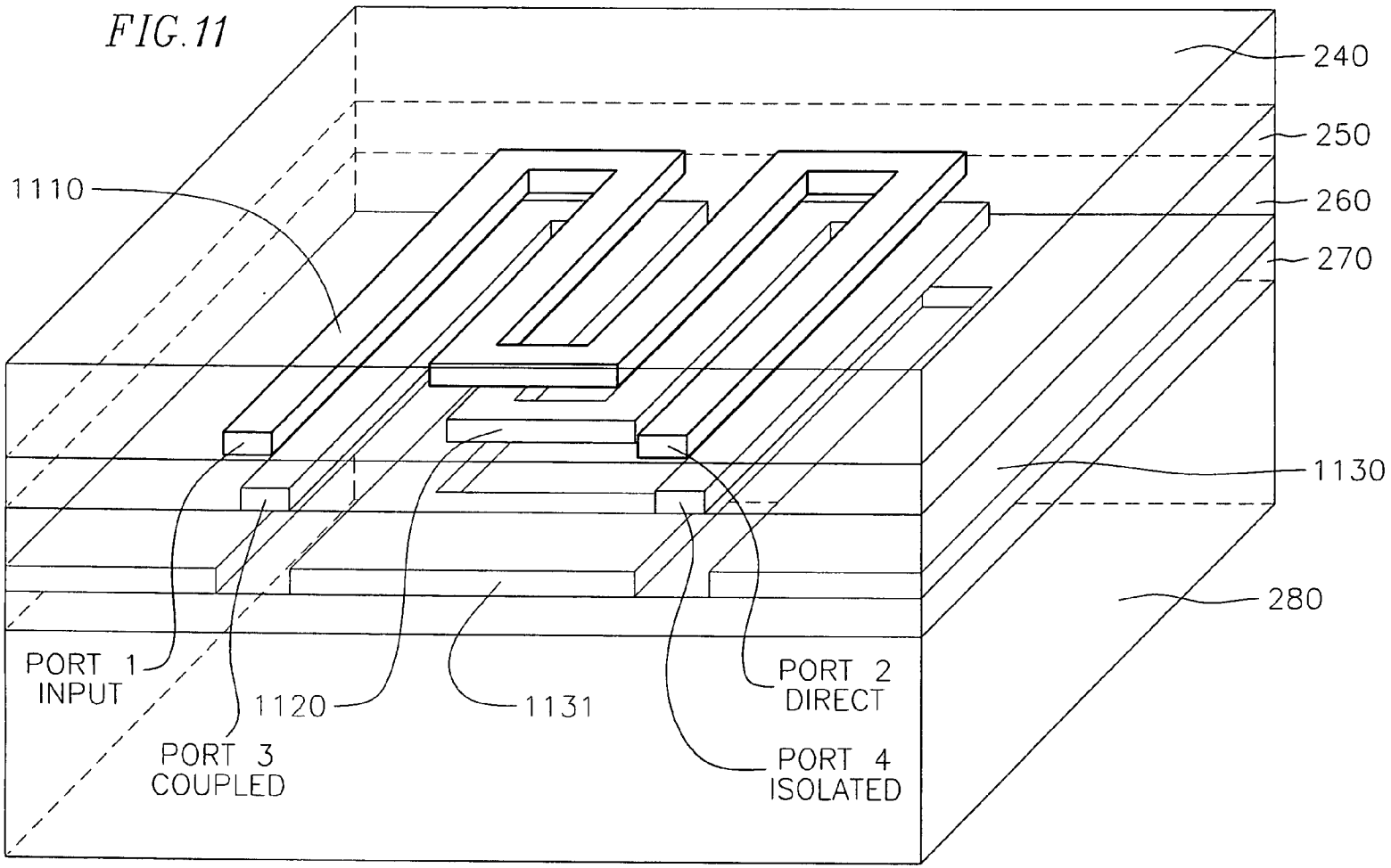
FIG. 11 is a simplified perspective view of fabricated three-dimensional quasi-coplanar broadside coupler in accordance with the present invention having conductor strips arranged in a meandering configuration and overlapping each other and with input and output ports of the coupler defined.
Figure 12:
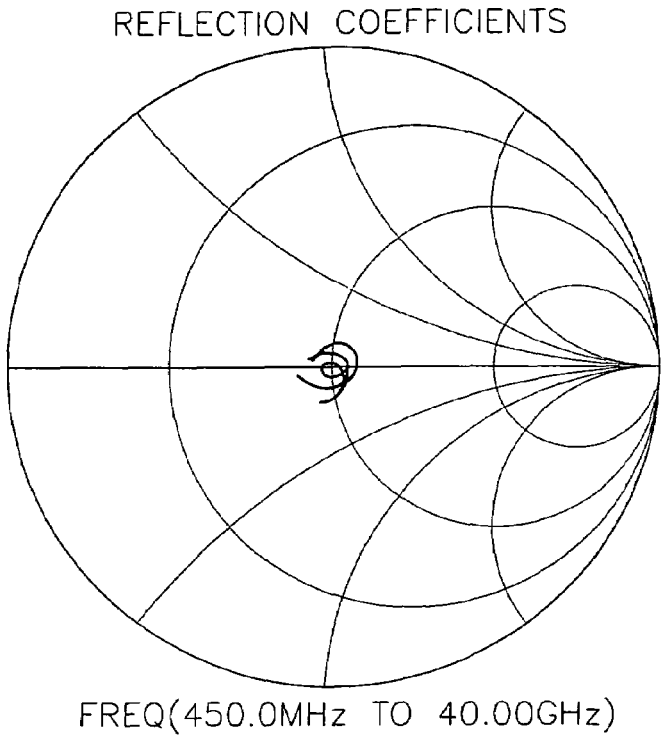
FIG. 12 is a Smith Chart graph depicting measured reflection coefficients of a fabricated three-dimensional quasi-coplanar broadside coupler in accordance with the present invention having conductor strips arranged in a meandering configuration.
Figure 13:
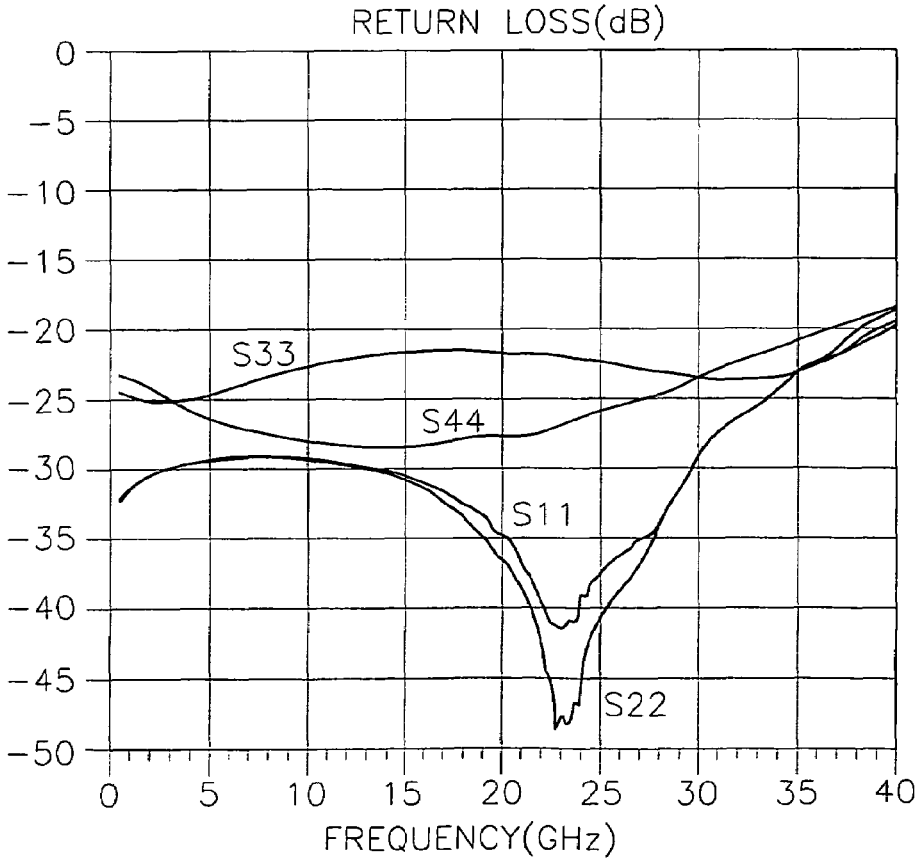
FIG. 13 is a graph depicting measured return loss in dB of a fabricated three-dimensional quasi-coplanar broadside coupler in accordance with the present invention having conductor strips arranged in a meandering configuration.
Figure 14:
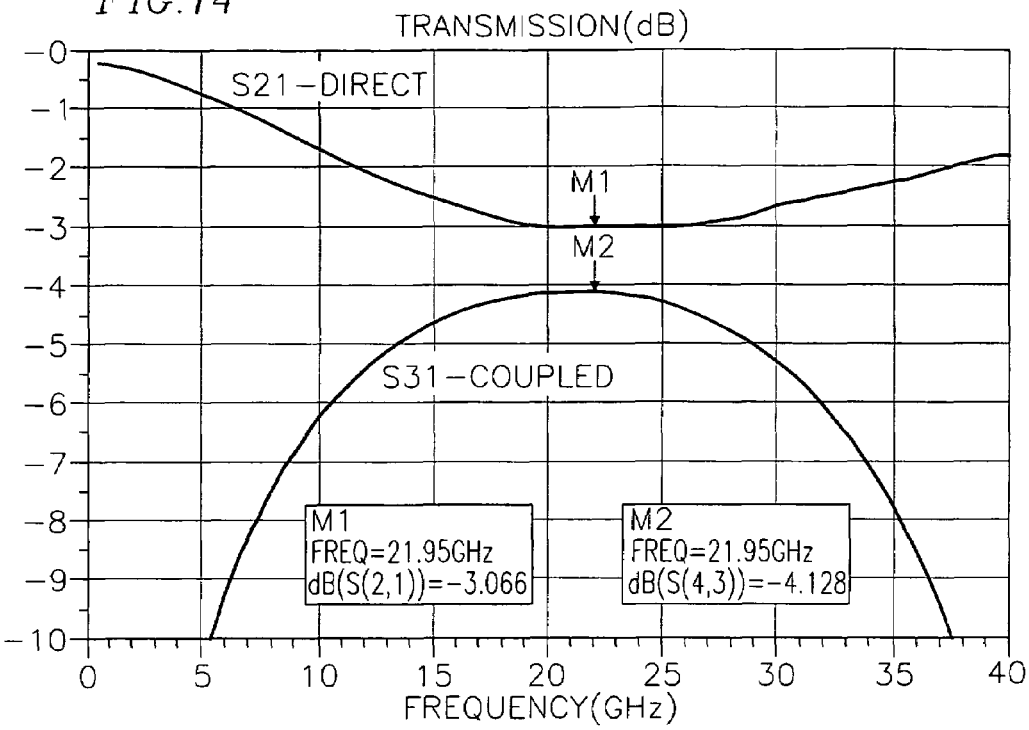
FIG. 14 is a graph depicting measured direct and coupled transmission in dB of a fabricated three-dimensional quasi-coplanar broadside coupler in accordance with the present invention having conductor strips arranged in a meandering configuration.
Figure 15:
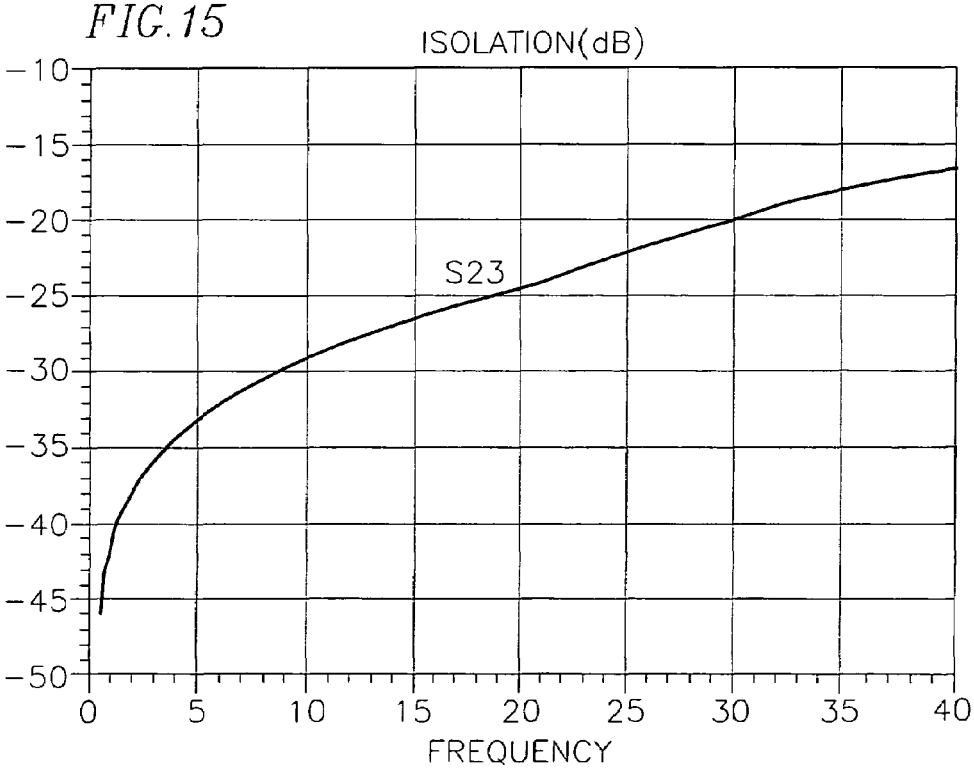
FIG. 15 is a graph depicting measured isolation in dB of a fabricated three-dimensional quasi-coplanar broadside coupler in accordance with the present invention having conductor strips arranged in a meandering configuration.
Figure 16:
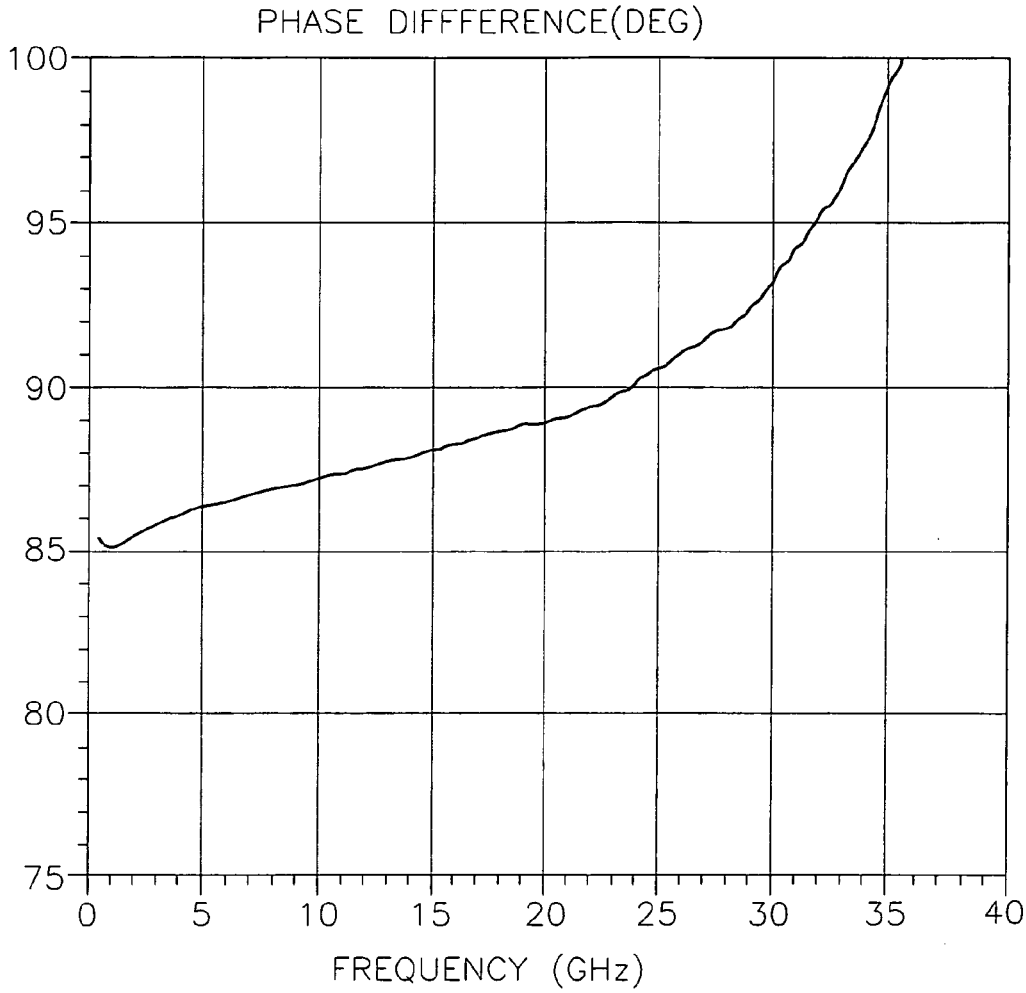
FIG. 16 is a graph depicting measured phase difference in degrees between direct and coupled output signals of a fabricated three-dimensional quasi-coplanar broadside coupler in accordance with the present invention having conductor strips arranged in a meandering configuration.

FIGS. 12 to 16 show various measured performances of a fabricated three-dimensional quasi-coplanar broadside quarter-wavelength coupler in accordance with the present invention for an operation at center frequency $f_0$=2 GHz. Conductor strips 1110, 1120 are arranged in a meandering configuration in accordance with FIG. 11 to reduce coupler cost. First conductor strip 1120 having width w1=8 μm and thickness of 1 μm is built on top of dielectric layer 260 of thickness h1=5 μm. Second conductor strip 1110 having width w2=8 μm and thickness of 2 μm is fabricated on top of dielectric layer 250 of thickness h2=2.5 μm. Substrate 280 is made of Gallium Arsenide of thickness 250 μm. On top of substrate 280 and below ground plane 1130 and 1131 is formed dielectric layer 270 of thickness 1 μm. Ground plane 1130, 1131 is 1 μm thick. Thickness of conductor strips 1110, 1120 fixed by the present technology does not constitute a restriction of any embodiment of the present invention. All dielectric materials are polyimide having a relative dielectric constant $\epsilon r$=3.5. In accordance with the present invention, ground plane 1130, 1131 is opened around conductor strips 1110 and 1120 with a gap $S_{gnd}$=5 μm to achieve isolation better than 20 dB at center frequency. In accordance with the present invention, conductor strips 1110, 1120 are overlapped by 4 μm on top of each other to achieve a coupling coefficient between the direct output port and the coupled output port of 0.88 (≈−1.1 dB). A thickness of top dielectric layer 240 of 3 μm enables the coupler to achieve a desired 90° phase difference between the coupled and the direct port.

What is claimed is:

1. A broadside microwave coupler supported on a substrate comprising:

a pair of electro-magnetically coupled conductors, the pair having a first conductive strip and a second conductive strip arranged in respective substantially parallel conductive strip planes;

a ground plane located in a plane substantially parallel to the parallel conductive strip planes, the first conductive strip being proximal to the ground plane and the second conductive strip being distal to the ground plane, the ground plane being between the first conductive strip and the substrate; and a dielectric material fully embedding therewithin the first conductive strip and the second conductive strip;

wherein the ground plane is open below the first conductive strip and the second conductive strip and is laterally separated from each farthest lateral extremity of the pair of electro-magnetically coupled conductors by a respective gap.

2. The broadside microwave coupler of claim 1, wherein the ground plane is fully embedded within the dielectric material.

3. The broadside microwave coupler of claim 1, wherein the dielectric material has a thickness providing homogeneity of material surrounding the pair of electro-magnetically coupled conductors.

4. The broadside microwave coupler of claim 1, wherein the pair of electro-magnetically coupled conductors are straight.

5. The broadside microwave coupler of claim 1, wherein the pair of electro-magnetically coupled conductors are arranged in a meandering configuration.

6. The broadside microwave coupler of claim 1, wherein the first conductive strip and the second conductive strip overlap each other.

7. The broadside microwave coupler of claim 6, wherein the first conductive strip and the second conductive strip are aligned to be centered on each other.

8. The broadside microwave coupler of claim 1, wherein the dielectric material includes layers of dielectric material.

9. The broadside microwave coupler of claim 1, wherein the dielectric material includes a dielectric layer formed between the ground plane and the substrate for fabrication of active devices on the substrate.

10. A method for providing phase balance in a broadside 90° microwave coupler supported on a substrate, the broadside 90° microwave coupler having an input port, a direct output port and a coupled output port, comprising:

providing a pair of electro-magnetically coupled conductors to be in quadrature phase between the direct output port and the coupled output port when a signal is applied to the input port, the pair having a first conductive strip and a second conductive strip arranged in respective substantially parallel conductive strip planes;

locating a ground plane in a plane substantially parallel to the parallel conductive strip planes, the first conductive strip being proximal to the ground plane and the second conductive strip being distal to the ground plane, the ground plane being between the first conductive strip and the substrate;

fully embedding the first conductive strip and the second conductive strip in a dielectric material; and providing an opening in the ground plane below the first conductive strip and the second conductive strip and laterally separating each farthest lateral extremity of the pair of electro-magnetically coupled conductors from the ground plane by a respective gap.

11. The method of claim 10, further comprising full embedding the ground plane within the dielectric material.

12. The method of claim 10, wherein the dielectric material has a thickness to provide substantial homogeneity of material surrounding the pair of electro-magnetically coupled conductors and the ground plane.

13. The method of claim 10, wherein the pair of electro-magnetically coupled conductors are straight.

14. The method of claim 10, wherein the pair of electro-magnetically coupled conductors are arranged in a meandering configuration.

15. The method of claim 10, further comprising overlapping the first conductive strip and the second conductive strip.

16. The method of claim 15, further comprising aligning the first conductive strip and the second conductive strip to be centered on each other.

17. The method of claim 10, wherein the dielectric material includes layers of dielectric material.

18. The method of claim 10, wherein the dielectric material includes a dielectric layer formed between the ground plane and the substrate for fabrication of active devices on the substrate.

* * * * *